US008985938B2

(12) United States Patent
Petty

(10) Patent No.: US 8,985,938 B2
(45) Date of Patent: Mar. 24, 2015

(54) FAN BLADE TIP CLEARANCE CONTROL VIA Z-BANDS

(75) Inventor: Dale William Petty, Wallingford, CT (US)

(73) Assignee: United Technologies Corporation, Hartford, CT (US)

( * ) Notice: Subject to any disclaimer, the term of this patent is extended or adjusted under 35 U.S.C. 154(b) by 634 days.

(21) Appl. No.: 13/324,143

(22) Filed: Dec. 13, 2011

(65) Prior Publication Data

US 2013/0149098 A1 Jun. 13, 2013

(51) Int. Cl.

| | |
|---|---|
| ***F01D 11/12*** | (2006.01) |
| ***F01D 11/00*** | (2006.01) |
| ***F01D 11/08*** | (2006.01) |
| ***F01D 11/18*** | (2006.01) |

(52) U.S. Cl.
CPC ..... *F01D 11/08* (2013.01); *F01D 11/005* (2013.01); *F01D 11/18* (2013.01)
USPC ..... 415/1

(58) Field of Classification Search
USPC ..... 415/127, 173.1, 173.3, 173.4, 174.2, 415/174.4, 1
See application file for complete search history.

(56) References Cited

U.S. PATENT DOCUMENTS

| | | | | |
|---|---|---|---|---|
| 3,146,992 | A | 9/1964 | Farrell | |
| 3,887,299 | A | 6/1975 | Profant | |
| 5,603,510 | A * | 2/1997 | Sanders | 277/413 |
| 6,203,273 | B1 | 3/2001 | Weiner et al. | |
| 6,547,522 | B2 * | 4/2003 | Turnquist et al. | 415/173.3 |
| 6,572,115 | B1 * | 6/2003 | Sarshar et al. | 277/412 |
| 6,655,696 | B1 * | 12/2003 | Fang et al. | 277/409 |
| 6,755,619 | B1 * | 6/2004 | Grylls et al. | 416/224 |
| 7,229,246 | B2 * | 6/2007 | Ghasripoor et al. | 415/173.3 |
| 7,407,369 | B2 | 8/2008 | Schwarz et al. | |
| 7,448,849 | B1 | 11/2008 | Webster et al. | |
| 7,686,575 | B2 * | 3/2010 | Chehab et al. | 415/136 |
| 7,713,021 | B2 * | 5/2010 | Finn et al. | 415/9 |
| 2005/0002780 | A1 | 1/2005 | Tanaka | |
| 2005/0175447 | A1 * | 8/2005 | Garner | 415/173.3 |
| 2005/0220610 | A1 * | 10/2005 | Ghasripoor et al. | 415/173.3 |
| 2008/0267770 | A1 * | 10/2008 | Webster et al. | 415/173.1 |
| 2009/0178383 | A1 | 7/2009 | Murphy et al. | |
| 2009/0196742 | A1 * | 8/2009 | Turnquist et al. | 415/174.2 |
| 2010/0239415 | A1 * | 9/2010 | Turnquist et al. | 415/174.2 |
| 2010/0303612 | A1 * | 12/2010 | Bhatnagar et al. | 415/127 |
| 2011/0044806 | A1 | 2/2011 | Harper | |
| 2011/0182719 | A1 * | 7/2011 | Deo et al. | 415/173.1 |

FOREIGN PATENT DOCUMENTS

| | | | |
|---|---|---|---|
| EP | 2290199 | A | 3/2011 |

* cited by examiner

*Primary Examiner* — Edward Look
*Assistant Examiner* — Aaron R Eastman
(74) *Attorney, Agent, or Firm* — Bachman & LaPointe, P.C.

(57) ABSTRACT

An engine has a blade, a casing surrounding the blade, an seal ring, and a passive system for connecting the seal ring to the casing and for accommodating thermal expansion of the seal ring relative to the casing so as to maintain blade tip clearance control. The passive system may include at least one, metallic Z-band extending between the casing and the seal ring.

20 Claims, 1 Drawing Sheet

FAN BLADE TIP CLEARANCE CONTROL VIA Z-BANDS

BACKGROUND

The present disclosure relates to a blade tip clearance control system, more specifically a fan blade tip clearance control system, to be used in engines such as gas turbine engines.

In a gas turbine engine, fan blades may be formed from an aluminum material, while the casing surrounding the fan blades may be formed from a composite material. There can be large differences in the thermal growth of these two materials. As a result, blade tip clearances may go beyond a desired range and fan efficiency may decrease.

SUMMARY

A system which helps maintain control of the blade tip clearance is highly desirable from the standpoint of obtaining fan efficiency.

In accordance with the present disclosure, there is provided an engine which broadly comprises a blade, a casing surrounding the blade, a seal ring, and a passive system for connecting the seal ring to the casing and for accommodating thermal expansion of the seal ring relative to the casing so as to maintain blade tip clearance control.

Further in accordance with the present disclosure, there is provided a method for maintaining blade clearance tip control in a fan section of an engine, which method broadly comprises the steps of: providing a fan casing formed from a composite material and a plurality of fan blades formed from an aluminum containing material; providing an annular seal ring; and providing a passive system for connecting the seal ring to the casing and for accommodating thermal expansion of the seal ring relative to the casing so as to maintain the blade tip clearance control.

Other details of the fan blade tip clearance control via Z-bands are set forth in the following detailed description and the accompanying drawings, wherein like reference numerals depict like elements.

DETAILED DESCRIPTION

Figure 1:
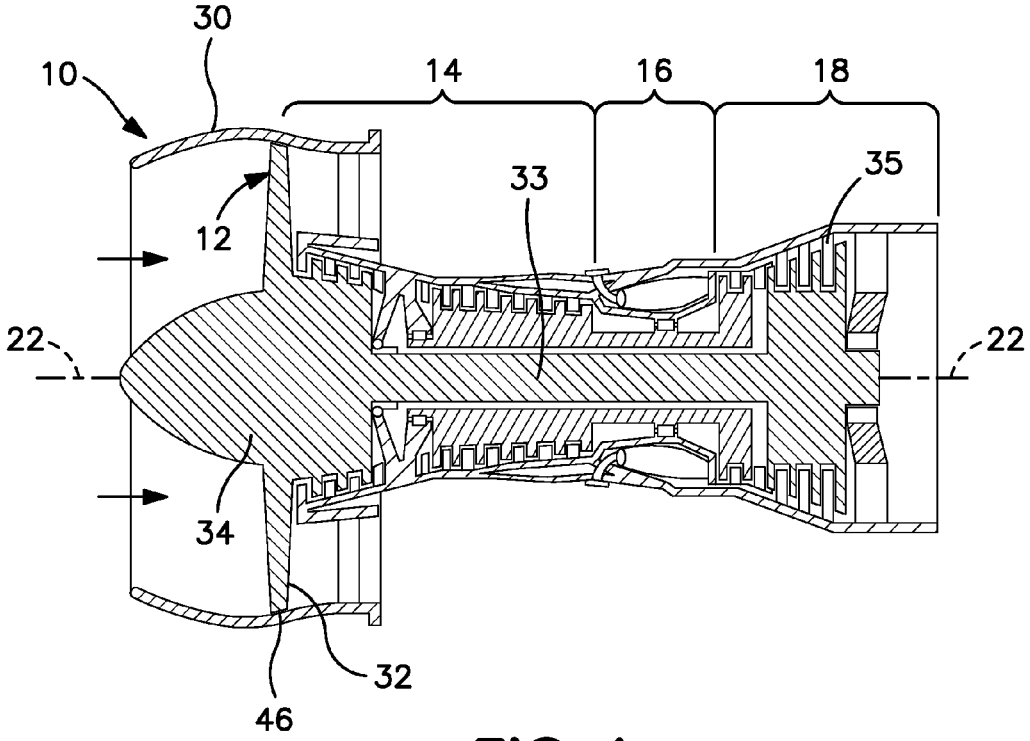
FIG. 1 is a schematic representation of a gas turbine engine having a fan section.

Referring now to FIG. 1, a gas turbine engine 10 is diagrammatically shown. The gas turbine engine 10 includes a fan section 12, a compressor section 14, a combustor section 16, and a turbine section 18. The gas turbine engine 10 has an axially extending centerline 22. Ambient air enters the engine 10 through the fan section 12. A fraction of that air subsequently travels through the compressor, combustor and turbine sections 14, 16, and 18 as core gas flow before exiting through a nozzle.

The fan section 12 includes a fan casing 30 and a plurality of fan blades 32 which rotate about the centerline 22. The fan blades 32 are each connected to a fan rotor disk 34 which may be driven by a spool or shaft 33 connected to a low pressure turbine array 35 in the turbine section 18. If desired, each fan blade 32 may be formed from an aluminum containing material such as an aluminum or an aluminum alloy where aluminum is present in an amount greater than 50 percent by weight.

The fan casing 30 may be formed from any suitable material. If desired, the fan casing 30 may be formed from a composite material such as an organic matrix composite material.

Figure 2:
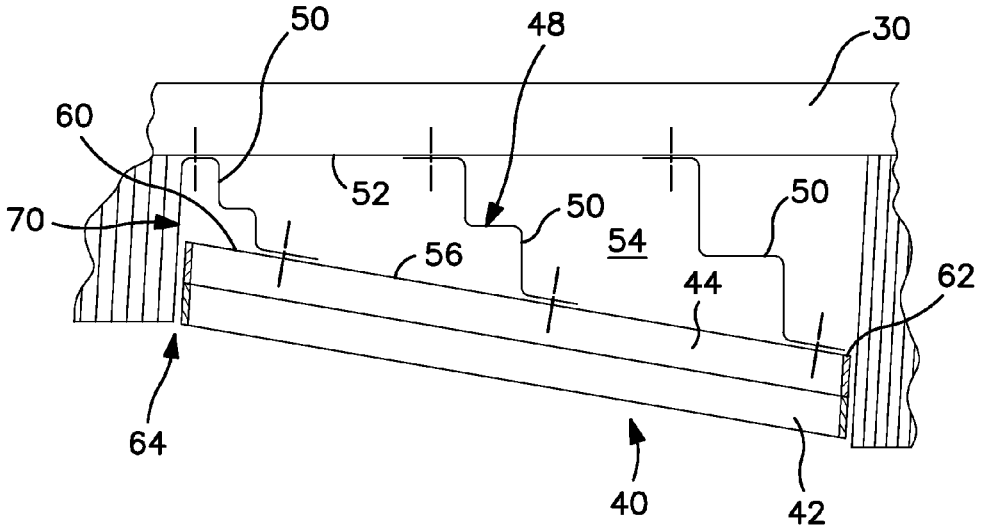
FIG. 2 is a sectional view of a system for maintaining blade tip clearance control.

Referring now to FIG. 2, the fan casing 30 is provided with a seal ring 40 such as an abradable seal ring. The seal ring 40 may comprise an annular rub strip 42 formed from an abradable material and an annular backing ring 44. The backing ring 44 may be formed from a metallic material such as an aluminum containing material including, but not limited to, aluminum and aluminum alloys where aluminum is present in an amount greater than 50 percent by weight. The backing ring 44 thus passively matches the thermal growth of the fan blades 32.

It is desirable to maintain a clearance distance between the seal ring 40 and the tip 46 of each fan blade 32. To this end, a passive system 48 for connecting the seal ring 40 to the fan casing 30 is provided. The passive system 48 accommodates thermal expansion of the seal ring 40 relative to the fan casing 30 so as to maintain blade tip clearance control. The system 48 is passive because it does not require the use of sensors, heating elements, piezoelectric materials, shape memory metal elements, fluid control systems, and the like.

The passive system 48 may comprise a plurality of Z-bands 50 extending between an inner wall 52 of an annular duct portion 54 of the fan casing 30 and the abradable seal ring 40. Each Z-band 50 may be formed from a non-corrugated, solid piece of metallic material such as nickel sheet material, a nickel alloy sheet material such as INCO 718, a steel sheet material, a titanium sheet material, an aluminum sheet material or a composite sheet material. The material which is used for each Z-band may have a thermal growth which falls between the thermal growth of the material forming the fan casing and the thermal growth of aluminum. Each Z-band 50 may have an annular configuration and extend about the entire inner periphery of the duct portion 54. Alternatively, each Z-band 50 may comprise an arc segment which extends about a portion of the inner periphery of the duct portion 54. If metallic, each Z-band may have a thickness in the range of 0.015 to 0.030 inches. If composite, each Z-band may have a thickness in a wider range of 0.015 to 0.060 inches due to fiber orientation and lay-up possibilities.

Each Z-band 50 may be attached to the inner wall 52 and to the exterior surface 56 of the backing ring 44. Any suitable means may be used to attach each Z-band 50 to the inner wall 52 and to the exterior surface 56. For example, nuts and bolts may be used to join each Z-band 50 to the inner wall 52 and the exterior surface 56.

As can be seen from the foregoing discussion, the fan casing 30 and the backing ring 44 are formed by different materials having different thermal expansion coefficients.

The Z-bands 50 allow the backing ring 44 to thermally expand relative to the fan casing 30. Each Z-band 50 may be provided with a thickness which is sufficiently thin so that the alpha thermal differences between the Z-bands 50 and the backing ring 44 have minimal influence on the backing ring 44 and hence blade tip clearance is maintained.

If desired, the passive system 48 may comprise multiple Z-bands, for example, three Z-bands 50 with a first of the Z-bands 50 being attached to a leading edge portion 60 of the seal ring 40, a second of the Z-bands 50 being attached to a trailing edge portion 62 of the seal ring 40, and a third of the Z-bands 50 is attached to the seal ring 40 intermediate of the first and second ones of the Z-bands 50.

The passive system 48 further comprises a slip joint 64 between the fan casing 30 and the abradable seal ring 40. The slip joint 64 may be located adjacent the leading edge and trailing edge portions 60 and 62 respectively of the seal ring 40 and a wall 70 of the fan casing 30.

The passive system 48 allows the seal ring 40 to grow different from the fan casing 30 and move thermally independent of the fan casing 30. As a result, increases in fan efficiencies may be obtained.

There has been provided in accordance with the instant disclosure a blade tip clearance control via z-bands. While the fan blade tip clearance control via z-bands has been described in the context of specific embodiments thereof, other unforeseen alternatives, modifications, and variations may become apparent to those skilled in the art having read the foregoing description. Accordingly, it is intended to embrace those alternatives, modifications, and variations as fall within the broad scope of the appended claims.

What is claimed is:

1. An engine comprising:

a blade;

a casing surrounding said blade;

a seal ring; and a passive system for connecting said seal ring to said casing and for accommodating thermal expansion of said seal ring relative to said casing so as to maintain blade tip clearance control, wherein said passive system comprises at least one non-corrugated, solid Z-band extending between said casing and said seal ring; and further comprising a slip joint between a wall of said casing and leading edge and trailing edge portions of said abradable seal ring.

2. The engine of claim 1, wherein said seal ring is an abradable seal ring.

3. The engine of claim 1, wherein said passive system comprises a plurality of spaced apart, non-corrugated, solid Z-bands.

4. The engine of claim 1, wherein said seal ring comprises an annular backing ring and an annular rub strip.

5. The engine of claim 4, wherein said annular backing ring is formed from aluminum or an aluminum alloy.

6. The engine of claim 4, wherein said annular rub strip is formed from an abradable material.

7. The engine of claim 1, wherein each said Z-band has a thickness which minimizes thermal alpha differences between each said Z-band and a material forming the annular backing ring.

8. The engine of claim 7, wherein said thickness is in a range of from 0.015 inches to 0.030 inches.

9. The engine of claim 1, wherein each said Z-band is formed from a nickel alloy sheet material.

10. The engine of claim 1, wherein each said Z-band is formed from a steel sheet material.

11. The engine of claim 1, wherein said blade is a fan blade and said casing is a fan casing.

12. The engine of claim 1, wherein said fan blade is formed from an aluminum containing material and said seal ring including an annular backing ring formed from an aluminum containing material.

13. The engine of claim 1, wherein said passive system comprises a first Z-band joined to a leading edge portion of said seal ring, a second Z-band joined to a trailing edge portion of said seal ring, and a third Z-band intermediate said first and second Z-bands.

14. The engine of claim 1, wherein said casing is formed from a composite material.

15. The engine of claim 14, wherein said composite material is an organic matrix composite material.

16. A method for maintaining blade clearance tip control in a fan section of an engine, said method comprising the steps of:

providing a fan casing formed from a composite material and a plurality of fan blades formed from an aluminum containing material;

providing an annular seal ring;

providing a passive system for connecting said seal ring to said casing and for accommodating thermal expansion of said seal ring relative to said casing so as to maintain said blade tip clearance control, wherein said passive system providing step comprises providing at least one non-corrugated, solid Z-band and connecting said at least one Z-band to an inner wall of said fan casing and to said seal ring; and wherein said passive system providing step comprises providing a slip joint between a wall of said fan casing and leading edge and trailing edge portions of the seal ring.

17. The method according to claim 16, wherein said annular seal ring providing step comprises providing a seal ring having an annular rub strip formed from an abradable material and an annular backing ring formed from an aluminum containing material.

18. The method according to claim 16, wherein at least one Z-band providing step comprises providing a plurality of Z-bands and said connecting step comprises connecting each of said Z-bands to said inner wall and to said seal ring.

19. The method according to claim 18, wherein said connecting step comprises connecting a first one of said Z-bands to a leading edge portion of said seal ring, a second of said Z-bands to a trailing edge portion of the seal ring, and a third one of said Z-bands to a portion of said seal ring intermediate said first and second ones of said Z-bands.

20. The method according to claim 16, further comprising forming each said Z-band from one of a nickel material, a nickel alloy material, a steel material, a titanium material, an aluminum material, and a composite material.

* * * * *